US008393057B2

(12) United States Patent
Wen

(10) Patent No.: US 8,393,057 B2
(45) Date of Patent: Mar. 12, 2013

(54) METHOD FOR MIXING SHORT STAPLE AND DOWN CLUSTER BY A DRY PROCESSING

(75) Inventor: Hsiu-Jung Wen, Taipei (TW)

(73) Assignee: Kwong Lung Enterprise Co., Ltd., Taipei (TW)

( * ) Notice: Subject to any disclaimer, the term of this patent is extended or adjusted under 35 U.S.C. 154(b) by 240 days.

(21) Appl. No.: 12/916,850

(22) Filed: Nov. 1, 2010

(65) Prior Publication Data

US 2012/0102694 A1 May 3, 2012

(51) Int. Cl.
*D01G 13/00* (2006.01)

(52) U.S. Cl. ..... 19/145.5

(58) Field of Classification Search ..... 19/4, 145, 19/145.5, 145.7
See application file for complete search history.

(56) References Cited

U.S. PATENT DOCUMENTS 2,739,391 A * 3/1956 Frederick et al. ..... 34/281
4,248,927 A * 2/1981 Liebman ..... 442/387
5,705,030 A * 1/1998 Gassner et al. ..... 162/2
6,232,249 B1 * 5/2001 Kawada ..... 442/352
7,074,242 B2 * 7/2006 Palmer et al. ..... 8/137
7,351,463 B2 * 4/2008 Chen ..... 428/76
7,418,769 B2 * 9/2008 Zhang ..... 19/296
2006/0143871 A1 * 7/2006 Zhang ..... 19/65 R

FOREIGN PATENT DOCUMENTS

CN 2534200 Y 2/2003
JP 10219526 A 8/1998
JP 3383855 A 12/2002

* cited by examiner

*Primary Examiner* — Shaun R Hurley
(74) *Attorney, Agent, or Firm* — Rabin & Berdo, P.C.

(57) ABSTRACT

A method for mixing short staple and down cluster by a dry processing utilizes an air tool to blow the short staple over, so that the scattered short staple is mixed in the down cluster. Stirring blades are further applied for stirring. Chemical agents are needless, no pollution is generated, and processing time is preferably reduced since the mixture does not have to be soaked in the chemical agent. Both the processing time and the manufacturing cost are decreased. Preferably, a proportion of the short staple to the down cluster is adjustable for different needs and divergent warmth retaining effects.

6 Claims, 5 Drawing Sheets

METHOD FOR MIXING SHORT STAPLE AND DOWN CLUSTER BY A DRY PROCESSING

BACKGROUND OF THE INVENTION

1. Field of the Invention

The present invention relates to a method for mixing short staple and down cluster by a dry processing, in particular to a method that employs an air tool to blow a short staple cluster over, thereby allowing the short staple cluster to be further mixed with the down cluster.

2. Description of the Related Art

Since feathers (down feather) are light and excellent in warmth retaining property, they are used abundantly in down wear, down quilts, sleeping bags, etc. Tucking down in the aforementioned products allows warmth to be retained around users. Preferably, the light feature of the down product provides users with a flexible motion.

However, down extracted from waterfowls, such as a goose and a duck, the down usually contains high water repellence. Herein, in view of the advanced water repellence, the down has to be dissolved in a hot water bath with chemicals for stirring, so that a functional processing treatment could be carried out. However, the treatment is actually inconvenient because of the minute and complicated preparation. Even the functional processing treatment is launched, the processed down adversely has a poor property of washing resistance. Moreover, the treatment cost is high, which results in the lack of practicability.

A Japanese Patent No. 3383855 stirs staple fibers and feathers that have the wettability after washing in a mixing process bath containing a surfactant system softening agent. The staple fibers are entwined with the barbule. Herein, the disclosed processing treatment needs an environment of high humidity for mixing the feather and the staple fibers. Obviously, such processing treatment simply takes time and the applied material is easily worn out. Thus, the limited operating environment and the long processing time are both unbenefited to the speedy productivity, which causes the applicant's endeavor to solve the disadvantages.

SUMMARY OF THE INVENTION

Accordingly, the applicant of the present invention made an effort to solve the disadvantages existing in the conventional method with a novel technique, so that an improved product could be expected for an advanced development in the industry.

A method for mixing short staple and down cluster by a dry processing comprises steps of:

(a) turning on an air tool in a blending trough for creating an air current therein and blowing the air current over a short staple cluster disposed in the blending trough, so that the short staple cluster subjected to blows of the air current is separated into strands of short staple;

(b) mixing the strands of short staple with a down cluster; a mixture of the strands of short staple and the down cluster being conveyed to a stirring tank disposed at a bottom of the blending trough;

(c) repeating step (a) to step (b) until the short staple cluster is used up;

(d) placing the redundant down cluster into the stirring tank and turning on stirring blades disposed in the stirring tank; and (e) taking the mixture of the strands of short staple and the down cluster into a gathering room disposed in the blending trough after a stirring process is completed.

A windmill motor is disposed at one side of the stirring tank; said windmill motor is communicated with an air tube that includes two air holes respectively defined at both sides of the stirring tank; a filter is installed on the air hole, and an entrance is disposed in the blending trough; the mixture of the strands of short staple with the down cluster is sucked into the stirring tank via the entrance while turning on the windmill motor in step (b).

A channel disposed at the other side of the stirring tank for being corresponding to the windmill motor is communicated with the gathering room.

The gathering room includes two accommodating rooms respectively communicated with the channel; a blocking member is disposed at a convergence of the channel and the accommodating rooms.

A proportion of the strands of short staple mixed with the down cluster is 1% to 30%; a preferable proportion of said mixture is 5% to 20%.

The present invention contributes to the following advantages:

By means of abovementioned steps, the stirring time and the stirring procedure in the stirring tank are shortened about within 20 minutes. Thus, the speedy productivity is achieved by the shortened stirring procedure.

Further, in time of mixing, no chemicals are needed, and the mixture of the short staple and the down also does not have to be soaked in any liquid. Accordingly, troubles correlated with the drainage, the heating facility, and the resulted pollution are all prevented for saving cost.

In addition, the proportion of the short staple to the down cluster can be adjusted in accordance with the practical property of the product to be made. For example, if the effect of retaining warmth is to be enhanced, the proportion of the short staple will be raised. On the other hand, the proportion of the short staple could be alternatively decreased for saving cost.

Following embodiments and correlated figures are believed to show a clear performance of the present invention.

DETAILED DESCRIPTION OF THE PREFERRED EMBODIMENTS

Figure 1:
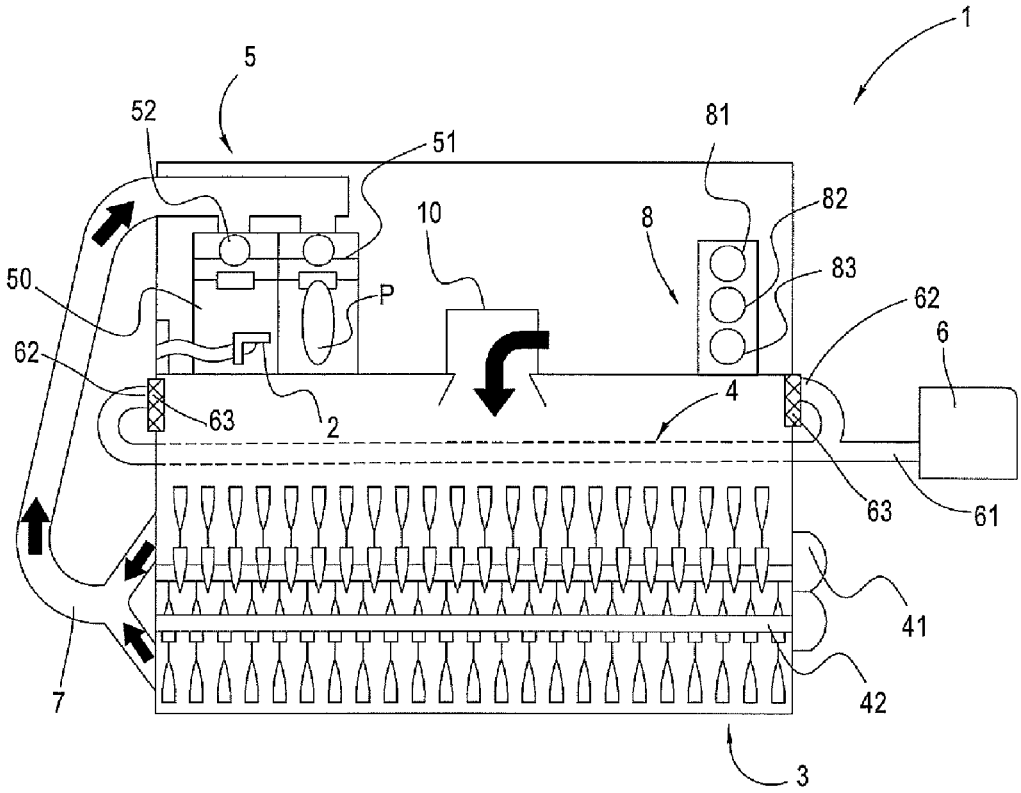
FIG. 1 is a schematic view showing a blending trough of the present invention.
Figure 2:
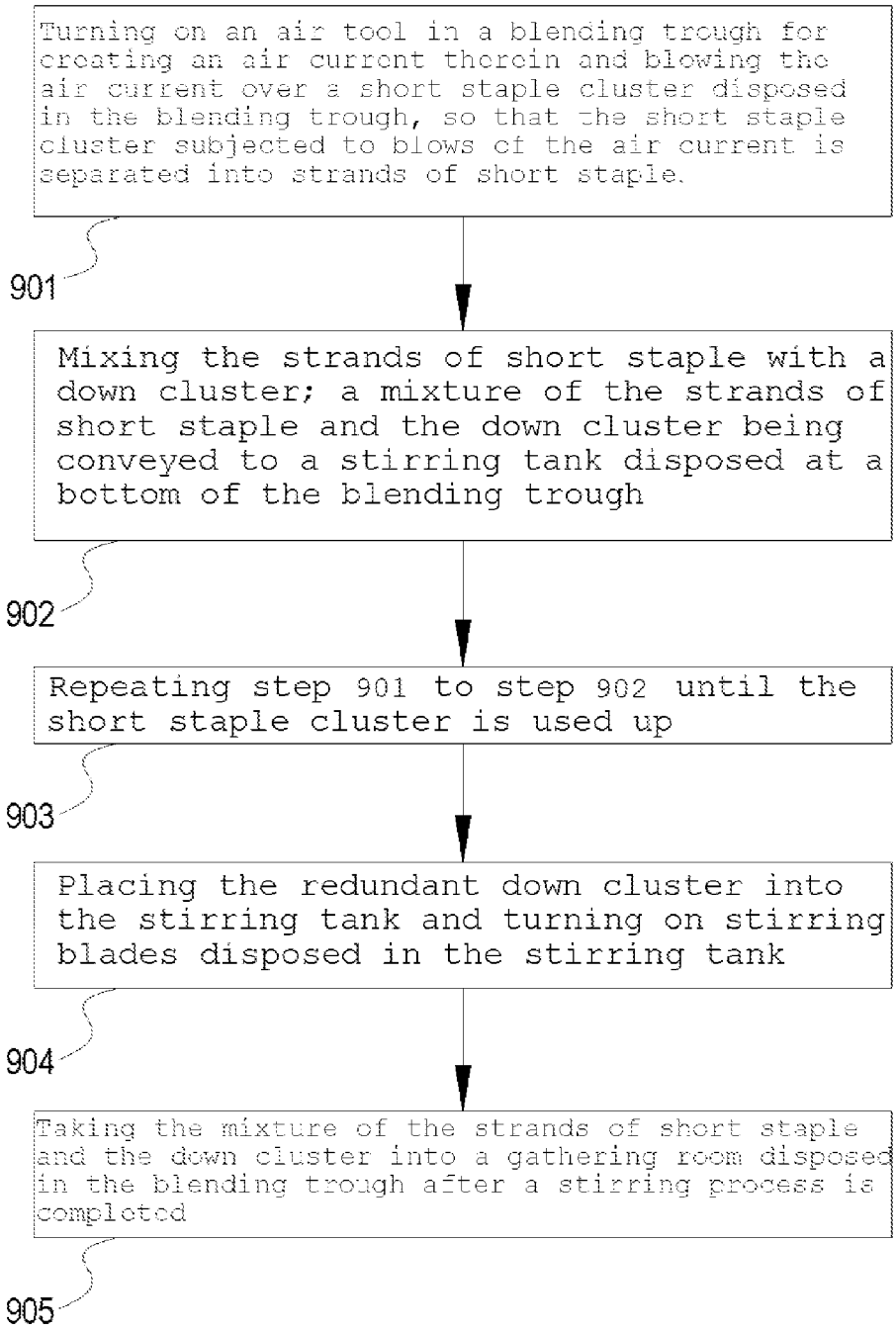
FIG. 2 is a flowchart showing the processing procedure of the present invention.
Figure 3:
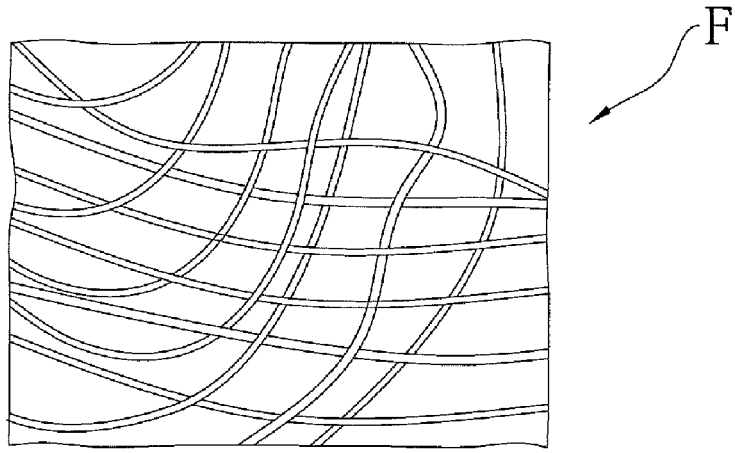
FIG. 3 is a schematic view showing the short staple cluster of the present invention.
Figure 4:
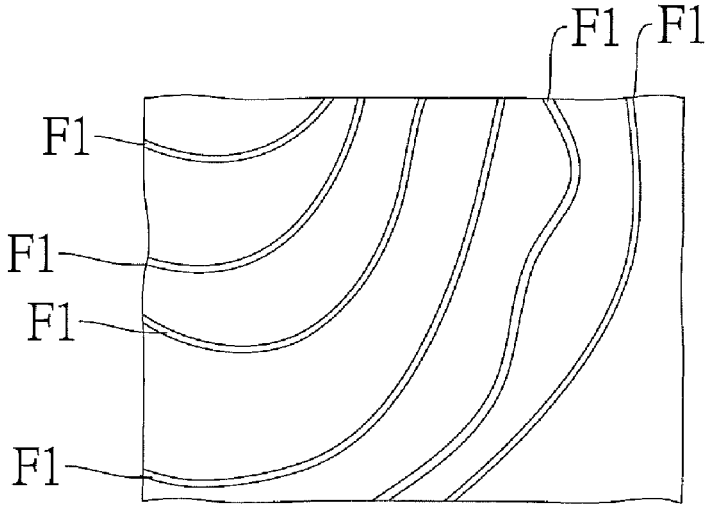
FIG. 4 is a schematic view showing strands of short staple formed by the scattered short staple cluster.
Figure 5:
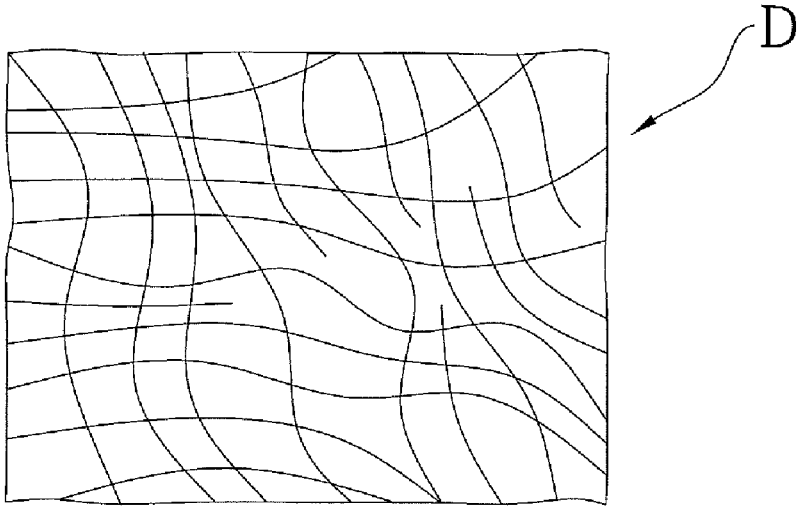
FIG. 5 is a schematic view showing a down cluster of the present invention.
Figure 6:
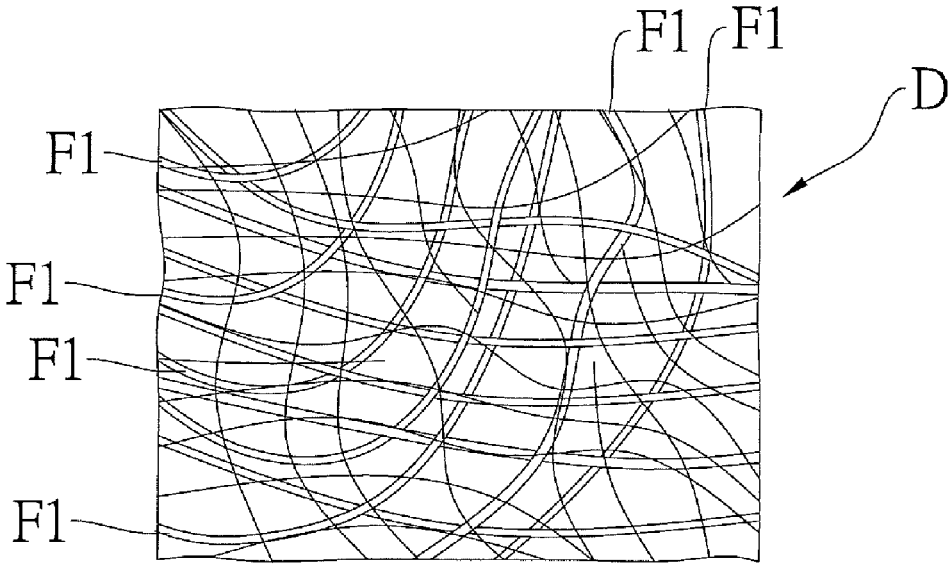
FIG. 6 is a schematic view showing a mixture of the short staple and the down cluster.

FIGS. 1 and 2 show a method for mixing short staple and down cluster by a dry processing comprising steps of:

(a) turning on an air tool 2 in a blending trough 1 for creating an air current and blowing the air current over a short staple cluster F disposed in the blending trough 1 (as shown in FIG. 3), so that the short staple cluster F subjected to blows of the air current is separated into strands F1 of short staple (as shown in FIG. 4) (901);

(b) mixing the strands F1 of short staple with a down cluster D (as shown in FIG. 5); a mixture of the strands of short staple and the down cluster (as shown in FIG. 6) being conveyed to a stirring tank 3 disposed at a bottom of the blending trough 1 (902);

(c) repeating step (a) to step (b) until the short staple cluster F is used up (903);

(d) placing the redundant down cluster D into the stirring tank 3 and turning on stirring blades 4 disposed in the stirring tank 3 (904); and (e) taking the mixture of the strands F1 of short staple and the down cluster D into a gathering room 5 disposed in the blending trough 1 after a stirring process is completed (905).

A windmill motor 6 is disposed at one side of the stirring tank 3. The windmill motor 6 is communicated with an air tube 61 that includes two air holes 62 respectively defined at both sides of the stirring tank 3. A filter 63 is further installed on the air hole 62, and an entrance 10 is disposed in the blending trough 1. Thereby, the mixture of the strands F1 of short staple and the down cluster D is sucked into the stirring tank 3 via the entrance 10 while turning on the windmill motor 6 in step (b).

Further, a channel 7 disposed at the other side of the stirring tank 3 for being corresponding to the windmill motor 6 is further communicated with the gathering room 5.

Moreover, the gathering room 5 includes two accommodating rooms 50, 51 respectively communicated with the channel 7. A blocking member 52 is disposed at a convergence of the channel 7 and the accommodating room 50.

According to the steps and the correlated figures above, the present invention is operated within the blending trough 1 that includes one air tool 2, one stirring tank 3, one set of stirring blades 4, one gathering room 5, one windmill motor 6, and one channel 7.

The stirring tank 3 is disposed at the bottom of the bending trough 1. The entrance 10 is disposed between the stirring tank 3 and the blending trough 1. The entrance 10, the stirring tank 3, and the blending trough 1 are intercommunicated with each other. The windmill motor 6 is disposed at one side of the stirring tank 3 and communicated with the air tube 61. The air tube 61 includes two air holes 62 that are respectively disposed at the side of the stirring tank 3. The filter 63 is disposed on the air hole 62. The flowing air current is created by the air tube 61. Disposed on the other side of the windmill motor 6, the channel 7 is communicated with the gathering room 5.

Two accommodating rooms 50, 51 included by the gathering room 5 are respectively communicated with the channel 7. The blocking member 52 is disposed at the convergence of the channel 7 and the accommodating room 50.

The set of the stirring blades 4 includes a stirring motor 41 and a blade unit 42. The stirring motor 41 is disposed out of the stirring tank 3. The blade unit 42 is disposed in the stirring tank. Preferably, the stirring motor 41 and the blade unit 42 are connected with each other.

A controller 8 disposed in the blending trough 1 further includes a feeding switch 81, a stirring switch 82, and an extruding switch 83. The feeding switch 81 and the extruding switch 83 are electrically connected to the windmill motor 6. The stirring switch 82 is electrically connected to the stirring motor 41.

In operation, the short staple cluster F and the down cluster D are placed in the blending trough 1. Thereby, the air tool 2 creates an air current. Thence, blowing over via the air current, the short staple cluster F is scattered into strands F1 of short staple. The strands F1 of short staple are mixed with the down cluster D. Accordingly, while the feeding switch 81 is turned on to motivate the windmill motor 6 for the air current to travel through the air tube 61 from the air hole 62, a mixture of the strands F1 of short staple and the down cluster is sucked in the stirring tank 3 via the entrance 10. Herein, the filter 63 prevents the strands F1 of short staple and the down cluster D from being sucked into the windmill motor 6. Aforementioned operation is repeatedly conducted until the short staple cluster F is used up.

Afterward, the redundant down fluster D is placed in the stirring tank 3 via the entrance 10. Thence, the stirring switch 82 is turned on for motivating the stirring motor 41. Thereby, the blade unit 42 is rotated for launching the stirring.

Certain operating time of the stirring has to be properly adopted. Namely, the rotation of the blade unit 42 has to be suspended for 2 minutes per 5-minute-operation. The procedure has to be conducted for three rounds. Accordingly, the total stirring time will be 15 minutes, and the total suspension will be 4 minutes. Such procedure contributes to the even mixture.

The extruding switch 83 is turned on after the completion of the stirring. Turning on the extruding switch 83 allows the windmill motor 6 to fan. Whereby, the mixture of the strands F1 of short staple and the down cluster D in the stirring tank 3 enters into the gathering room 5 via the channel 7. Preferably, the rotating blade unit further provides the mixture of the strands F1 of short staple and the down cluster D with an additional push for achieving a smooth traveling into the channel, so that a convenient gathering is resulted.

Two accommodating rooms 50, 51 included by the gathering room 5 are respectively connected to the channel 7. Both the strands F1 of short staple and the down cluster D are gathered for entering the accommodating rooms 50, 51. The blocking member 52 (or a valve switch) is further disposed at the exit of the channel 7 with respect to the accommodating room 50. By means of the blocking member 52, a blockage between the accommodating rooms 50, 51 and the channel 7 is formed therebetween. Thereby, the mixture of the strands F1 of short staple and the down cluster D would selectively enter the accommodating rooms 50, 51. Succeedingly, a weaving bag P is disposed on the convergence among the exit of the channel 7 and the accommodating rooms 50, 51 for collecting the mixture of the strands F1 of short staple and the down cluster.

The present invention conduces to a speedy mixture and avoids the pollutant generated in the conventional wet processing, which contributes to an inventive step.

In fact, the aim of mixing the strands F1 of short staple and the down cluster D is to achieve a mixture that retains warmth since the strands F1 of short staple are featured by retaining the absorbed warmth. Herein, the proportion for mixing the strands F1 of short staple with the down cluster D will be discussed later in the specification. It should be noted that a proportion of the strands F1 of short staple mixed with the down cluster D is 1% to 30%. Preferably, a proportion of the strands F1 of short staple mixed with the down cluster is 5% to 20%.

An experimentation for observing a relationship between the effect of retaining warmth and the proportion of the strands of short staple F1 in the mixture is conducted by the following means: A halogen lamp of 500 W is set away from a sample by 100 centimeters for 10 minutes. Thence, an infrared thermal imager measures the surface temperature of the sample. Accordingly, a comparison between a before-temperature and an after-temperature of the surface of the sample will be conducive to a conclusion as follows.

Figure 7:
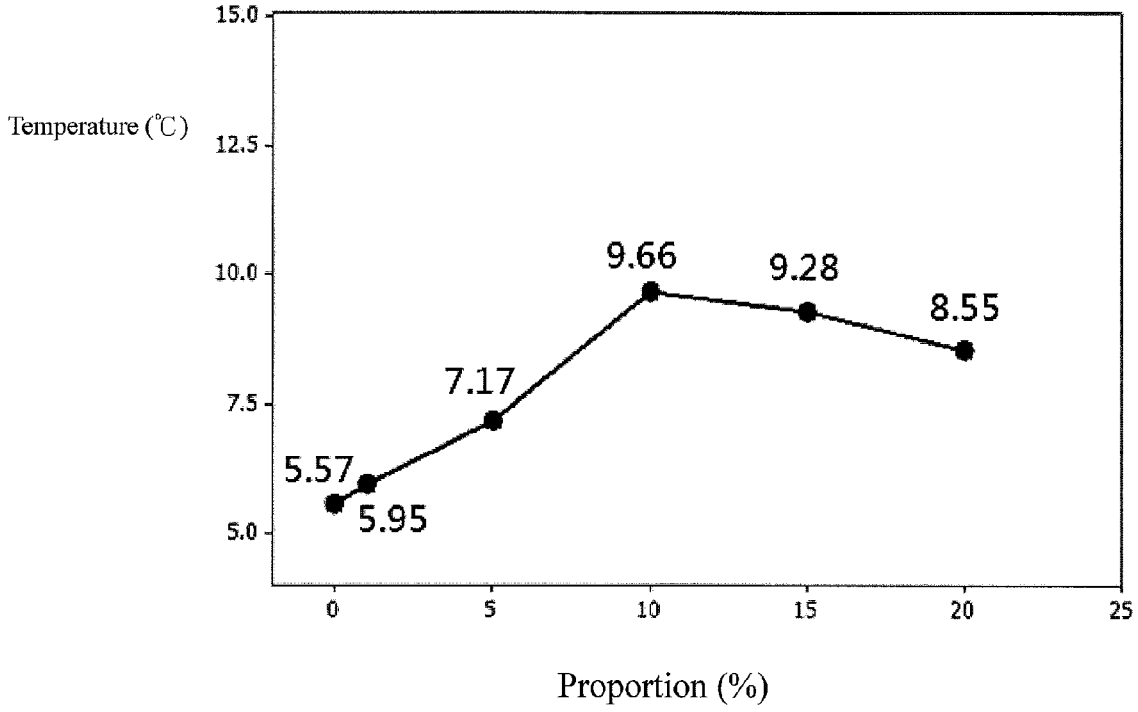
FIG. 7 is an experimental statistic of the present invention.

Referring to FIG. 7, an obvious warmth retaining effect is achieved while the proportion of the strands F1 of short staple is set from 1% to 20%. Moreover, when the weight proportion of the strands F1 of short staple is assumed from 1% to 20%, the mixture of the strands F1 of short staple and the down cluster D has a better warmth retaining effect than that of the cluster D without the strands F1 of short staple.

The following Forms 1 to 3 present three different tests on the temperature that proves the superior warmth retaining effect while adding the strands F1 of short staple (increased temperature as follows is indicated to the surface increased temperature of the sample; compared temperature as follows is indicated to the comparison of the increased temperature of the sample added with the strands F1 of short staple to the increased temperature of the sample without the strands F1 of short staple):

FORM 1

| | NO SHORT STAPLE | 1% | 5% | 10% | 15% | 20% |
|---|---|---|---|---|---|---|
| INCREASED TEMPERATURE | +5.57° C. | +5.95° C. | +7.17° C. | +9.66° C. | +9.28° C. | +8.55° C. |
| COMPARED TEMPERATURE | +0° C. | +0.38° C. | +1.60° C. | +4.09° C. | +3.71° C. | +2.98° C. |

FORM 2

| | NO SHORT STAPLE | 1% | 5% | 10% | 15% | 20% |
|---|---|---|---|---|---|---|
| INCREASED TEMPERATURE | +6.04° C. | 6.45° C. | +7.98° C. | +8.89° C. | +8.3° C. | +8.06° C. |
| COMPARED TEMPERATURE | +0° C. | +0.41° C. | +1.94° C. | +2.85° C. | +2.26° C. | +2.02° C. |

FORM 3

| | NO SHORT STAPLE | 1% | 5% | 10% | 15% | 20% |
|---|---|---|---|---|---|---|
| INCREASED TEMPERATURE | +7.4° C. | +8.24° C. | +9.61° C. | +10.55° C. | +9.79° C. | +9.72° C. |
| COMPARED TEMPERATURE | +0° C. | +0.84° C. | 2.21° C. | +3.15° C. | +2.39° C. | +2.32° C. |

Above embodiments demonstrate the inventive steps of the present invention for the patentability. Embodiments presented in the present invention do not limit the creative, novel, and non-obvious spirits involved in the techniques and functions of the same.

What is claimed is:

1. A method for mixing short staple and down cluster by a dry processing comprising the steps of:

(a) turning on an air tool in a blending trough for creating an air current therein and blowing said air current over a short staple cluster disposed in said blending trough, so that said short staple cluster subjected to blows of said air current is separated into strands of short staple;

(b) mixing said strands of short staple with a down cluster, a mixture of said strands of short staple and said down cluster being conveyed to a stirring tank disposed at a bottom of said blending trough;

(c) repeating step (a) to step (b) until said short staple cluster is used up;

(d) placing redundant down cluster of the down cluster into said stirring tank and turning on stirring blades disposed in said stirring tank in a stirring process; and (e) taking said mixture of said strands of short staple and said down cluster into a gathering room disposed in said blending trough after the stirring process is completed.

2. The method as claimed in claim 1, wherein a windmill motor is disposed at one side of said stirring tank, said windmill motor is communicated with an air tube that includes two air holes respectively defined at the one side and another side of said stirring tank, filters are installed on said air holes, and an entrance is disposed in said blending trough, wherein said mixture of said strands of short staple with said down cluster is sucked into said stirring tank via said entrance while turning on said windmill motor in step (b).

3. The method as claimed in claim 2, wherein a channel is disposed at the another side of said stirring tank, the channel for corresponding with the windmill motor, the channel being communicated with said gathering room.

4. The method as claimed in claim 3, wherein said gathering room includes two accommodating rooms respectively communicated with said channel, further wherein a blocking member is disposed at a convergence of said channel and said accommodating rooms.

5. The method as claimed in claim 1, wherein, a proportion of said strands of short staple is 1% to 30% of the mixture of said strands of short staple and said down cluster.

6. The method as claimed in claim 5, a proportion of said short staple is 5% to 20% of the mixture of said strands of short staple and said down cluster.

* * * * *